US011744284B2

(12) United States Patent
Liu et al.

(10) Patent No.: US 11,744,284 B2
(45) Date of Patent: Sep. 5, 2023

(54) ULTRASONIC ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Hong Yu, Hunan (CN); Yuangang Dai, Hunan (CN); Xinqiang Yin, Hunan (CN); Jianhua Yi, Hunan (CN); Yongquan Zhou, Hunan (CN); Chaoxiang Huang, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 638 days.

(21) Appl. No.: 16/647,437

(22) PCT Filed: Sep. 30, 2018

(86) PCT No.: PCT/CN2018/109112
§ 371 (c)(1),
(2) Date: Mar. 13, 2020

(87) PCT Pub. No.: WO2019/063016
PCT Pub. Date: Apr. 4, 2019

(65) Prior Publication Data

US 2020/0253279 A1 Aug. 13, 2020

(30) Foreign Application Priority Data

Sep. 30, 2017 (CN) ..... 201710914785.7
Sep. 30, 2017 (CN) ..... 201710924470.0
Sep. 30, 2017 (CN) ..... 201721283605.1

(51) Int. Cl.
*A24F 40/46* (2020.01)
*A24F 40/10* (2020.01)
(Continued)

(52) U.S. Cl.
CPC ..... *A24F 40/05* (2020.01); *A24F 40/40* (2020.01); *A24F 40/44* (2020.01); *A24F 40/46* (2020.01); *A24F 40/10* (2020.01); *A24F 40/50* (2020.01)

(58) Field of Classification Search
CPC ..... A24F 40/10; A24F 40/46
See application file for complete search history.

(56) References Cited

U.S. PATENT DOCUMENTS

2015/0258288 A1* 9/2015 Sullivan ..... A24F 40/485 128/203.12
2019/0166913 A1* 6/2019 Trzecieski ..... A61M 15/06
2019/0208823 A1* 7/2019 Raich ..... A61K 36/185

FOREIGN PATENT DOCUMENTS

CN 206390302 U 8/2017
CN 206714084 U 12/2017
(Continued)

OTHER PUBLICATIONS

International Search Report issued in International Application No. PCT/CN2018/109112 dated Jan. 14, 2019, 2 pages.

*Primary Examiner* — Russell E Sparks
(74) *Attorney, Agent, or Firm* — Mauriel Kapouytian Woods LLP; Liang Huang

(57) ABSTRACT

An ultrasonic electronic cigarette is disclosed. The electronic cigarette includes a housing (1) provided with an atomization sheet assembly (2) and a cartridge (3) therein. The atomization sheet assembly (2) comprises an ultrasonic atomization sheet (4) and an atomization seat (5) for supporting and fixing the ultrasonic atomization sheet (4). A top cover (7) is connected to the top end of the housing (1). A
(Continued)

suction nozzle (8) is connected to the top cover (7). A press plate (9) and a locking mechanism (10) for controlling the press plate (9) to be opened or closed are also disposed in the housing (1). The cartridge (3) is fixed in the press plate (9). When the top cover (7) is closed and the locking mechanism (10) is locked, the press plate (9) and/or the cartridge (3) abut against the atomization sheet assembly (2).

19 Claims, 13 Drawing Sheets

(51) Int. Cl.

| | |
|---|---|
| ***A24F 40/05*** | (2020.01) |
| ***A24F 40/44*** | (2020.01) |
| ***A24F 40/40*** | (2020.01) |
| *A24F 40/50* | (2020.01) |

(56) References Cited

FOREIGN PATENT DOCUMENTS

| | | | |
|---|---|---|---|
| WO | 2015/197165 | A1 | 12/2015 |
| WO | 2016/128562 | A1 | 8/2016 |

* cited by examiner

ULTRASONIC ELECTRONIC CIGARETTE

CROSS REFERENCE TO RELATED APPLICATIONS

This application is a U.S. National Phase application under 35 U.S.C. § 371 of International Application No. PCT/CN2018/109112 filed on Sep. 30, 2018, which claims priority to Chinese Application Number 201710924470.0 filed on Sep. 30, 2017, Chinese Application Number 201710914785.7 filed on Sep. 30, 2017, and Chinese Application Number 201721283605.1 filed on Sep. 30, 2017.

FIELD OF THE INVENTION

The present invention belongs to the technical field of electronic cigarettes, and particularly relates to an ultrasonic electronic cigarette.

BACKGROUND OF THE INVENTION

An ultrasonic electronic cigarette includes a housing provided with an atomization sheet assembly and a cartridge therein, the atomization sheet assembly includes an ultrasonic atomization sheet and an atomization seat for supporting and fixing the ultrasonic atomization sheet, the cartridge is filled with tobacco tar, and the cartridge is in contact with an atomization surface of the ultrasonic atomization sheet and supplies the tobacco tar to the ultrasonic atomization sheet for atomization to generate smoke. The housing is provided with an air inlet hole, a top cover for sealing an opening of the housing is connected to the top end of the housing, a suction nozzle is connected to the top cover, and the air inlet hole, the atomization surface of the ultrasonic atomization sheet, and the suction nozzle are communicated in sequence. Air enters from the air inlet hole, passes through the atomization surface of the ultrasonic atomization sheet, and then takes away the smoke generated by the atomization, and the smoke enters the mouth through the suction nozzle for the user to suck.

The existing ultrasonic electronic cigarette has the following disadvantages:

First, when the atomization sheet assembly is replaced, the top cover is first unscrewed, then the cartridge is unscrewed, and the atomization sheet assembly is finally unscrewed, so the steps are tedious, the hands are easily stained with the tobacco tar, the cartridge and the atomization sheet assembly may scald the hands, and the user experience is poor.

Second, when the cartridge is replaced, the top cover is first unscrewed, and then the cartridge is unscrewed, so the steps are tedious, the hands are easily stained with the tobacco tar, the cartridge may scald the hands, and the user experience is poor.

Third, when the cartridge is replaced, because the ultrasonic atomization sheet is not supplied with tobacco tar at this time, if a key is accidentally triggered to switch on the circuit, the ultrasonic atomization sheet will dry out, which shortens the service life of the ultrasonic atomization sheet and increases the cost of use.

SUMMARY OF THE INVENTION

In view of the shortcomings of the prior art, the present invention is directed to provide an improved ultrasonic electronic cigarette, where an atomization sheet assembly is convenient to replace, and the hands are not easily stained with tobacco tar or scalded; a cartridge is convenient to replace, and the hands are not easily stained with tobacco tar or scalded; and when the cartridge is replaced, even if a key is accidentally triggered, the ultrasonic atomization sheet will not dry out, so the service life of the ultrasonic atomization sheet is long, the cost of use is low, and the user experience is good.

In order to solve the above technical problems, the technical solution adopted by the present invention is as follows:

An ultrasonic electronic cigarette is provided, including a housing provided with an atomization sheet assembly and a cartridge therein, wherein the atomization sheet assembly includes an ultrasonic atomization sheet and an atomization seat for supporting and fixing the ultrasonic atomization sheet, a top cover for sealing an opening of the housing is connected to the top end of the housing, a suction nozzle is connected to the top cover, and the structure characteristic of the ultrasonic electronic cigarette is that a press plate and a locking mechanism for controlling the press plate to be opened or closed are also disposed in the housing, and the cartridge is fixed in the press plate; when the top cover is closed and the locking mechanism is locked, the press plate and/or the cartridge abut against the atomization sheet assembly, and the cartridge is in contact with an atomization surface of the ultrasonic atomization sheet; and when the top cover is opened and the locking mechanism is unlocked, the press plate drives the cartridge to be separated from the ultrasonic atomization sheet, and the atomization sheet assembly is exposed.

With the above structure, when the atomization sheet assembly needs to be mounted, the press plate is unlocked by the locking mechanism, then the press plate is opened to carry the cartridge out, at the same time, the atomization sheet assembly is released from the pressing of the press plate such that the atomization sheet assembly is exposed in the space without abutment of the press plate, and finally the atomization sheet assembly is taken out. The step of manually rotating the cartridge out can be omitted, the operation is relatively simple, the phenomenon of staining the hand with tobacco tar or scalding the hand when the hand rotates the cartridge is avoided, and the user experience is good. In addition, if the top cover can be turned over at an angle more than or equal to 90° based on the original angle, the cartridge or the atomization sheet assembly can be dumped out, so the operation is simple and convenient; meanwhile, it is easier, simpler, more practical and convenient to replace the cartridge or the atomization sheet assembly and clean the tobacco tar on the press plate.

As a preferred manner, the locking mechanism includes a lock shaft, a key handle, a clamping shaft, a first spring, a rotating shaft, a rotating shaft seat, a lock, and an elastic member for springing off the press plate when the locking mechanism is unlocked; the lock is fixedly connected to the press plate, the rotating shaft seat is fixed on a support in the housing, one end of the press plate is rotatably connected to one end of the rotating shaft seat through the rotating shaft, the lock shaft is disposed in a through slot of the rotating shaft seat, the key handle is fixedly connected to one end of the lock shaft and can drive the lock shaft to move within the through slot, and the other end of the lock shaft is provided with a lock hook matching the lock; one end of the clamping shaft is connected to the lock shaft, one end of the first spring abuts against the rotating shaft seat, and the other end of the first spring abuts against the other end of the clamping shaft.

When the press plate is locked, the lock hook is locked with the lock. The key handle is pressed, the key handle pushes the lock shaft to move, and at the same time, the clamping shaft compresses the first spring until the lock is released from the lock hook to unlock. After the press plate is unlocked, the elastic member springs off the press plate. Because the cartridge is clamped on the press plate, the cartridge is also carried out together. When the hand releases, the clamping shaft and the lock shaft are ejected by the first spring, and the key handle is reset.

Further, the ultrasonic electronic cigarette includes an ejection shaft, wherein the ejection shaft is arranged in a groove at the top of the support in the housing and can move up and down within the groove, a second spring is also disposed in the groove, the top end of the second spring abuts against the inner top surface of the ejection shaft, and the bottom end of the second spring abuts against the bottom surface of the groove; when the press plate is locked, the press plate presses the ejection shaft and compresses the second spring through the atomization seat; and when the press plate is unlocked, the second spring is reset and the atomization sheet assembly is ejected by the ejection shaft.

When the lock hook is connected to the lock, the press plate presses the ejection shaft through the atomization seat. When the atomization sheet assembly needs to be replaced, the top cover is opened first (if the cartridge does not need to be replaced, the cartridge does not need to be taken out), the key handle is pressed to unlock the lock hook and the lock, and the press plate is unlocked and opened. After the press plate is opened, the second spring ejects the atomization sheet assembly through the ejection shaft, and the electronic cigarette is tilted to pour out the atomization sheet assembly for replacing or cleaning the atomizing cavity of the atomization sheet assembly, so the operation is simple, the disadvantages that hands are scalded and stained with tobacco tar by manual disassembly or screwing can be solved, the purpose of automatically springing off the atomization sheet assembly for replacement without touching the atomization sheet assembly is achieved, and the practicality of the electronic cigarette is improved.

Further, a moving member capable of moving up and down is also disposed in the housing, and a first seal ring is also disposed in the top cover; when the top cover is closed, the top cover presses the ejection shaft and compresses the second spring through the first seal ring, the cartridge, the moving member, and the atomization seat in sequence; and when the top cover is opened, the second spring is reset and ejects the cartridge through the atomization seat and the moving member in sequence.

With the above structure, the cartridge is disposed in the moving member, and when the moving member moves, the cartridge moves with the moving member.

When the top cover is opened, the cartridge is not subjected to a downward pressing force, so the elastic force of the second spring lifts the ejection shaft, the atomization sheet assembly, and the moving member to eject the cartridge, and the user tilts the electronic cigarette to pour out and take away the cartridge conveniently, thereby achieving the purpose of replacing the cartridge without touching the tobacco tar by hand.

Further, an elastic electrode is also disposed on the support; when the atomization seat presses the ejection shaft and compresses the second spring, the elastic electrode abuts against a first conductive layer on the inner bottom surface of the ultrasonic atomization sheet; and when the second spring is reset, the atomization seat drives the ultrasonic atomization sheet to move up to be separated from the elastic electrode.

When the top cover is closed, the press plate presses the atomization seat down, thereby pressing the ejection shaft and the second spring down. At this time, the second spring is in a compressed state, the elastic electrode abuts against the ultrasonic atomization sheet, and the circuit is turned on. Accordingly, in a normal smoking state, the ejection shaft is pressed by the atomization seat, which can not only achieve a stable electrical connection of the ultrasonic atomization sheet, but also seal the atomization seat and the ejection shaft to prevent the leakage of smoke. When the cartridge or the atomization sheet assembly needs to be replaced, the press plate is unlocked and opened. Since the ultrasonic atomization sheet is not in contact with the elastic electrode, the ultrasonic atomization sheet cannot operate, which prevents the ultrasonic atomization sheet from being dried out at a no load state by mistakenly triggering the key when the cartridge is replaced, and prolongs the service life of the atomization sheet.

As a preferred manner, the atomization seat is in a tapered seat, and the inner lateral surface of the tapered seat and the outer lateral surface of the atomization seat are both tapered surfaces whose diameters are reduced from top to bottom.

When the press plate is unlocked and opened, the ejection shaft pops up the atomization sheet assembly, at this time, the outer side wall of the atomization seat is not in contact with the inner side wall of the tapered seat, and the electronic cigarette can be tilted to pour out the atomization sheet assembly for easy replacement. Since the inner lateral surface of the tapered seat and the outer lateral surface of the atomization seat are both tapered surfaces whose diameters are reduced from top to bottom, the both have certain taper for easier assembly.

As a preferred manner, the tapered seat is made of a conductive material, and a pin on a second conductive layer of the ultrasonic atomization sheet passes through the atomization seat and is electrically connected to the tapered seat.

When the press plate is locked, both the elastic electrode and the conductive tapered seat are electrically connected to the ultrasonic atomization sheet to form a working circuit.

As a preferred manner, when the top cover is closed, the key handle is in the top cover; and when the top cover is opened, the key handle is exposed.

When the top cover is closed, the key handle is hidden inside the top cover, which prevents a mistaken operation on the key handle from affecting the smoking effect and improves the practicality.

As a preferred manner, the bottom of the inner lateral surface of the first seal ring is a tapered surface whose diameter is reduced from bottom to top; and when the top cover is closed, the top of the cartridge abuts against the bottom of the inner lateral surface of the first seal ring.

When the top cover is closed, the first seal ring is in interference connection with the cartridge, thus preventing smoke from leaking out of the connection position to affect the smoking effect. At the same time, when the top cover is closed, since the bottom of the inner side wall of the first seal ring is a tapered surface whose diameter is reduced from bottom to top, the inserted position of the cartridge can be automatically corrected to obtain better sealing performance.

Further, a slider, a rotating tongue and a third spring are also disposed in the housing, the rotating tongue is sleeved on the rotating shaft and can rotate around the rotating shaft, one end of the rotating tongue is fixedly connected to one end of the top cover, the other end of the rotating tongue is provided with a first lateral surface and a second lateral surface that are adjacent, the slider and the third spring are both disposed in a lateral opening of the rotating shaft seat, one end of the third spring abuts against the slider, and the other end of the third spring abuts against the rotating shaft seat; when the top cover is closed, the lateral surface of the slider abuts against the first lateral surface of the rotating tongue and compresses the third spring; and when the top cover is opened, the rotating tongue rotates around the rotating shaft, so that the lateral surface of the slider abuts against the second lateral surface of the rotating tongue.

In the initial state, because the third spring has a rightward elastic force, the lateral surface of the slider abuts against the first lateral surface, and the top cover covers the press plate tightly and is prevented from loosening to affect the smoking effect; when the top cover is opened, the top cover is first turned over around the rotating shaft, at this time, the rotating tongue pushes the slider to move so as to compress the third spring; after the top cover is turned over to a certain angle, the slider pushes the rotating tongue to the right due to the rightward restoring force of the third spring, and the top cover automatically rotates around the rotating shaft to be open till the lateral surface of the slider abuts against the second lateral surface of the rotating tongue, so the operation is convenient and the operational reliability is high.

Further, a main board and a switch key for controlling operation of the main board are also fixed on the support in the housing, the support is provided with a limiting slot with a downward opening, the top end of a side panel of the housing is disposed in the limiting slot and can move within the limiting slot, and a raised portion opposite to the switch key is formed inside the side panel.

The switch key is operated by using the side panel, so that the force area is large and the comfort is high.

Further, a fourth spring is also disposed in the housing, one end of the fourth spring is sleeved on the switch key, and the other end of the fourth spring is sleeved on the raised portion.

Further, the inner bottom surface of the first seal ring has a downward boss portion, and the top end of the cartridge, the inner bottom of the first seal ring and the boss portion define a first tobacco tar blocking cavity.

With the above structure, after the top cover is tightly closed, the top end of the cartridge, the inner bottom of the first seal ring and the boss portion form a first tobacco tar blocking cavity, so that when smoke passes by, large granular tobacco tar beads are blocked within the first tobacco tar blocking cavity to prevent from sucking the tobacco tar.

Further, the inner diameter of the upper section of the suction nozzle is smaller than the inner diameter of the lower section of the suction nozzle.

Because the inner diameter of the upper section of the suction nozzle is smaller than the inner diameter of the lower section of the suction nozzle, the lower section of the suction nozzle forms a second tobacco tar blocking cavity, and when smoke passes, large granular tobacco tar beads are blocked within the second tobacco tar blocking cavity to prevent from sucking the tobacco tar.

As a preferred manner, the ultrasonic electronic cigarette is an ultrasonic electronic cigarette in liquid form in which the cartridge is filled with tobacco tar and the ultrasonic atomization sheet is used to atomize the tobacco tar in the cartridge, the housing is provided with an air inlet hole, and the air inlet hole, the atomization surface of the ultrasonic atomization sheet, and the suction nozzle are communicated in sequence.

As a preferred manner, the elastic member is a torsion spring, and the torsion spring is sleeved on the rotating shaft and located between the press plate and the support.

When the lock hook is connected to the lock, the torsion spring is twisted, that is, the torsion spring has an upward torsion around the rotating shaft, and the press plate presses the ejection shaft through the atomization seat. After the press plate is unlocked, since the lock is locked on the press plate, and the torsion spring is fixed on the rotating shaft and the rotating shaft seat, the torsion of the torsion spring after unlocking causes the press plate to spring up around the rotating shaft. Since the cartridge is clamped on the press plate, the cartridge is also taken out together, and the second spring ejects the atomization sheet assembly through the ejection shaft.

Compared with the prior art, the present invention has the advantages that the atomization sheet assembly is convenient to replace, and the hands are not easily stained with tobacco tar or scalded; the cartridge is convenient to replace, and the hands are not easily stained with tobacco tar or scalded; and when the cartridge is replaced, even if the key is accidentally triggered, the ultrasonic atomization sheet will not dry out, so the service life of the ultrasonic atomization sheet is long, the cost of use is low, the operational reliability is high, and the user experience is good.

Figure 1:
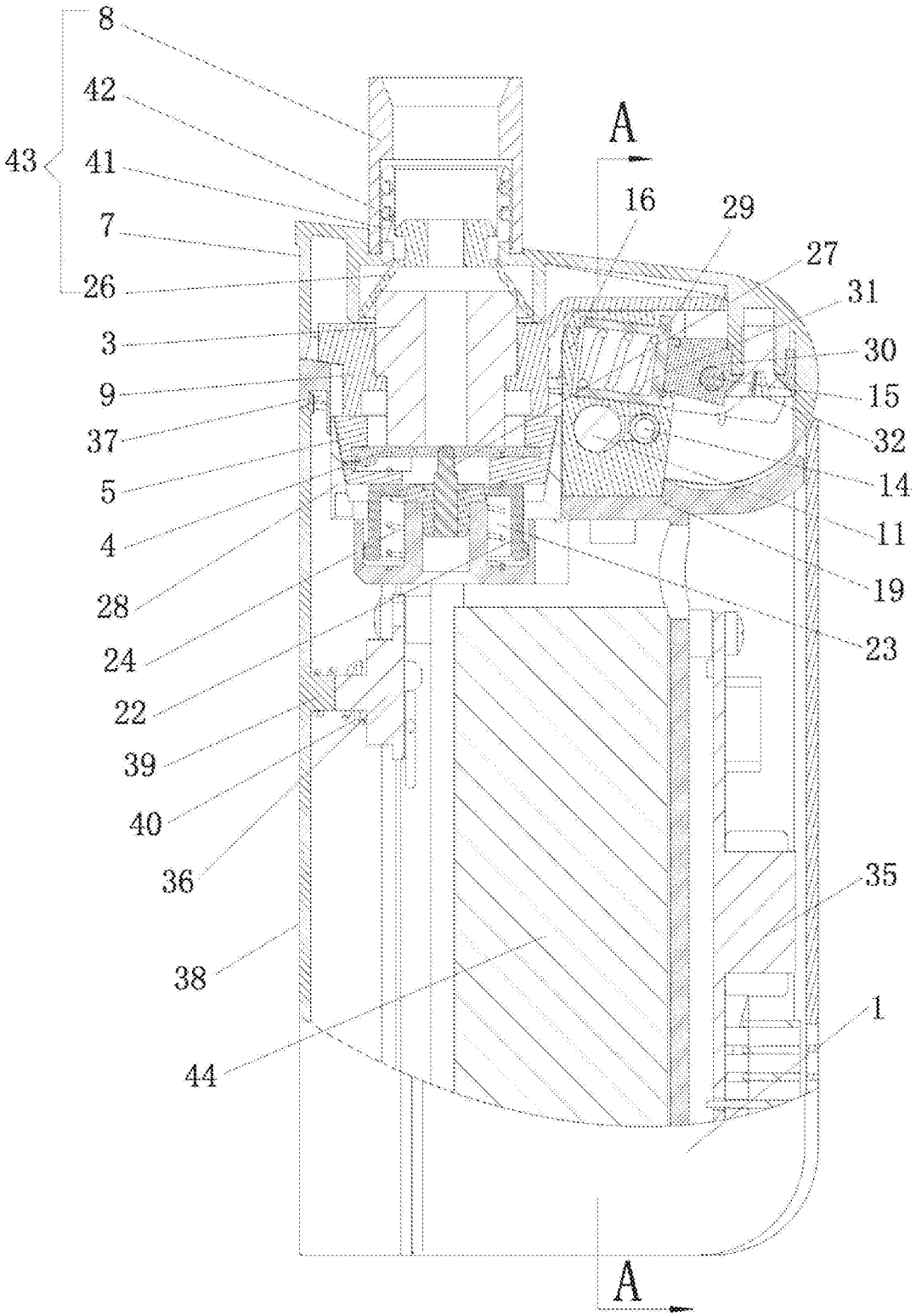
FIG. 1 is a schematic structural diagram of Embodiment 1 of an electronic cigarette in a use state.
Figure 2:
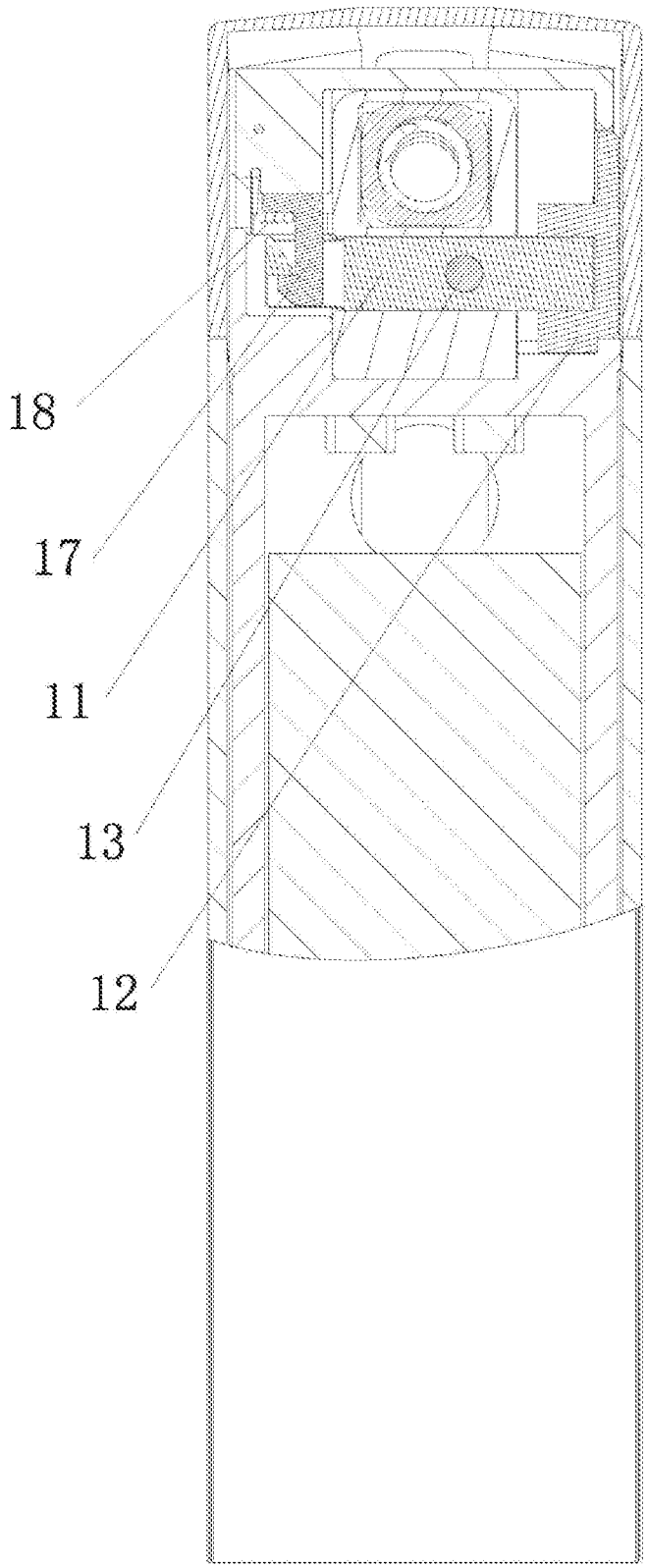
FIG. 2 is a cross-sectional view of A-A in FIG. 1.
Figure 3:
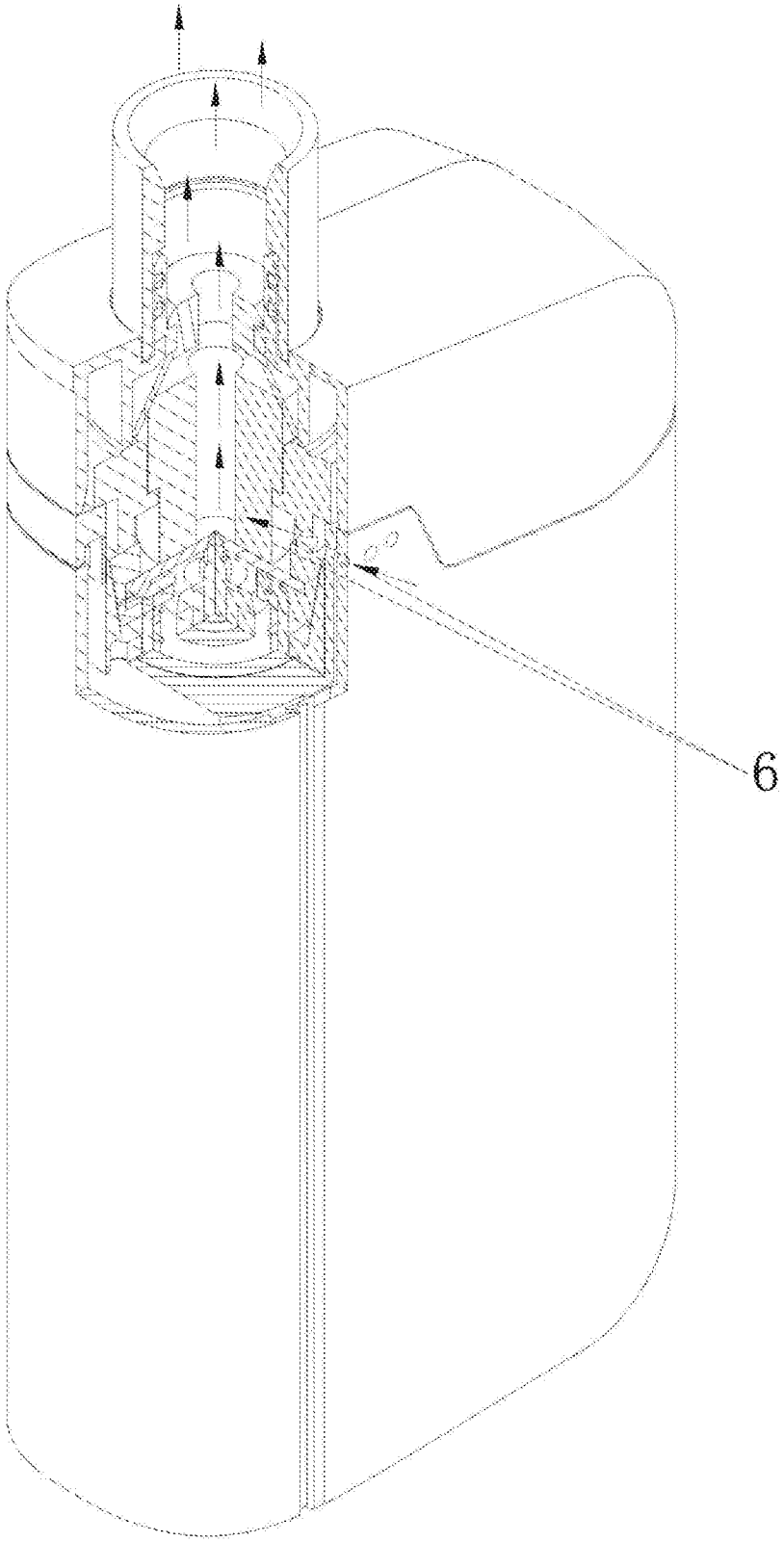
FIG. 3 is a schematic diagram of an air flow direction of Embodiment 1 of the electronic cigarette.
Figure 4:
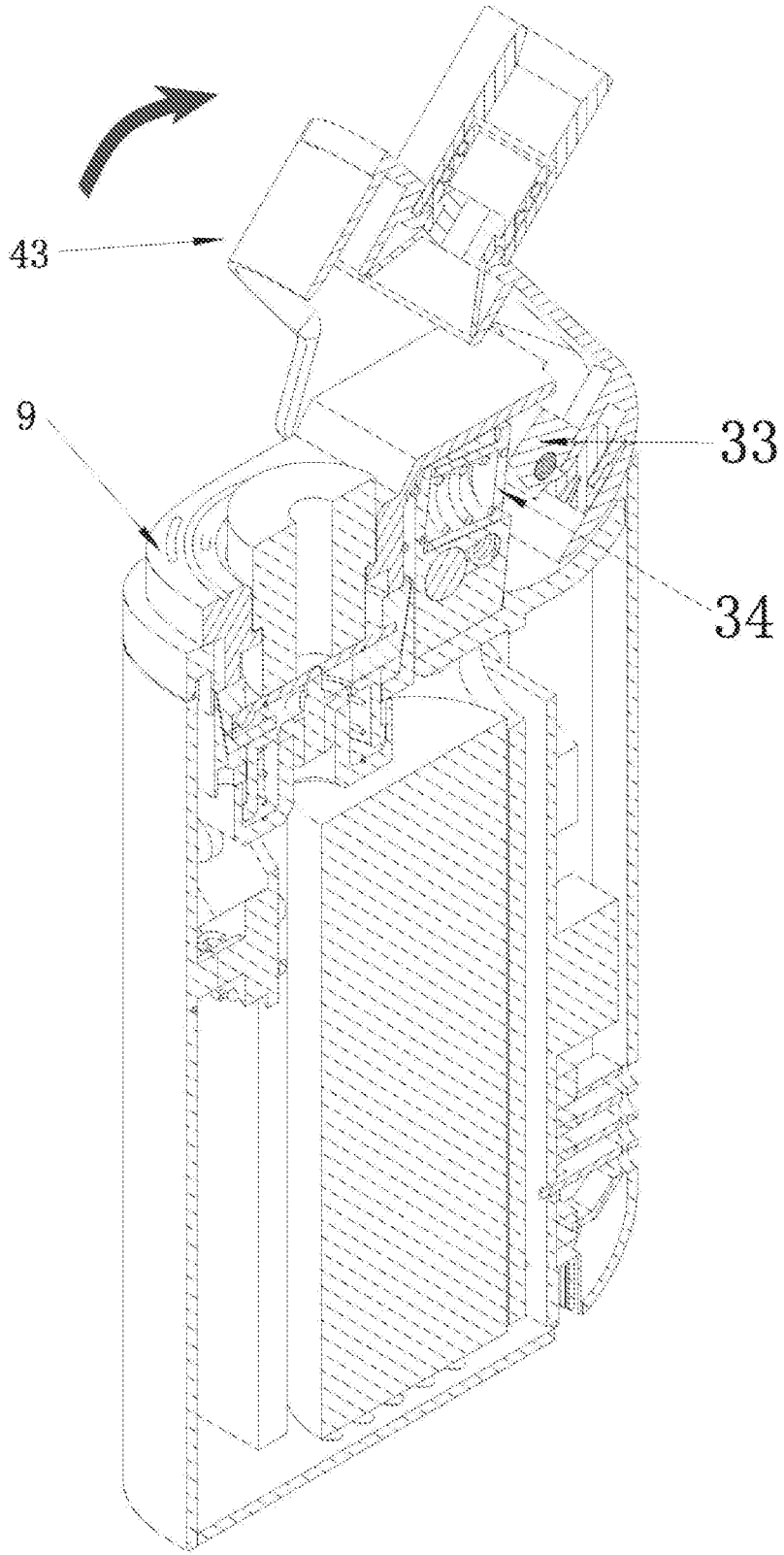
FIG. 4 is a schematic structural diagram of Embodiment 1 of the electronic cigarette when a top cover is opened.
Figure 5:
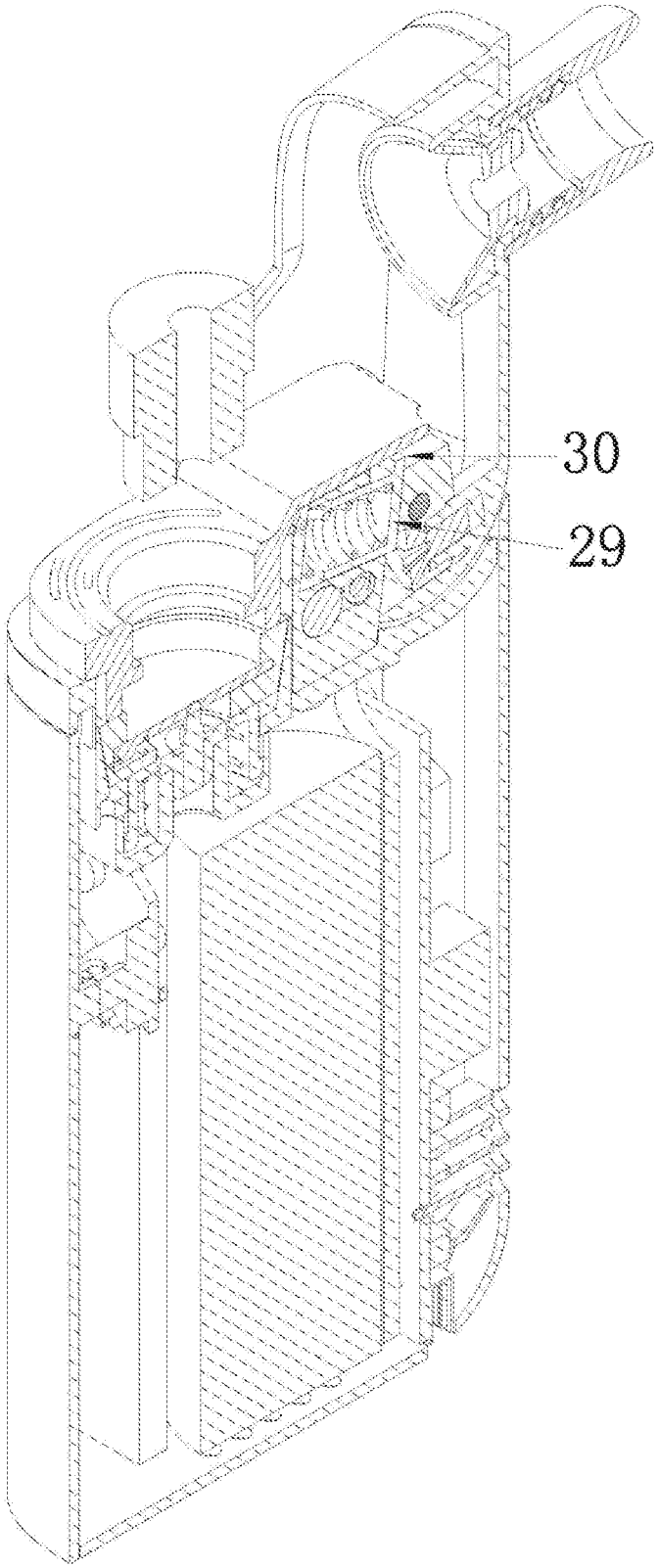
FIG. 5 is a schematic structural diagram of Embodiment 1 of the electronic cigarette after the top cover is opened.
Figure 6:
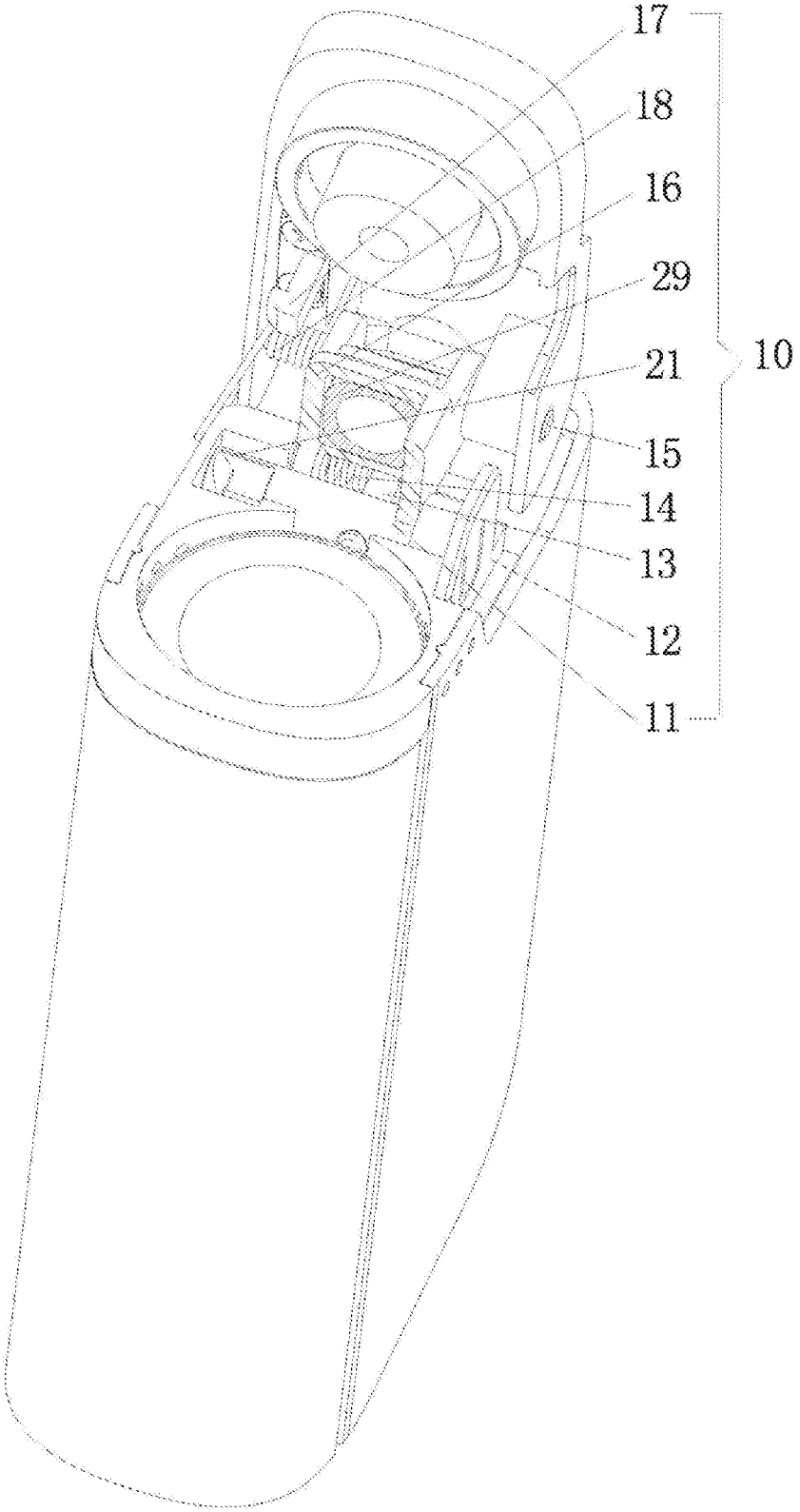
FIG. 6 is a schematic diagram of Embodiment 1 of the electronic cigarette when an atomization sheet assembly is replaced after a top cover assembly is hidden.
Figure 7:
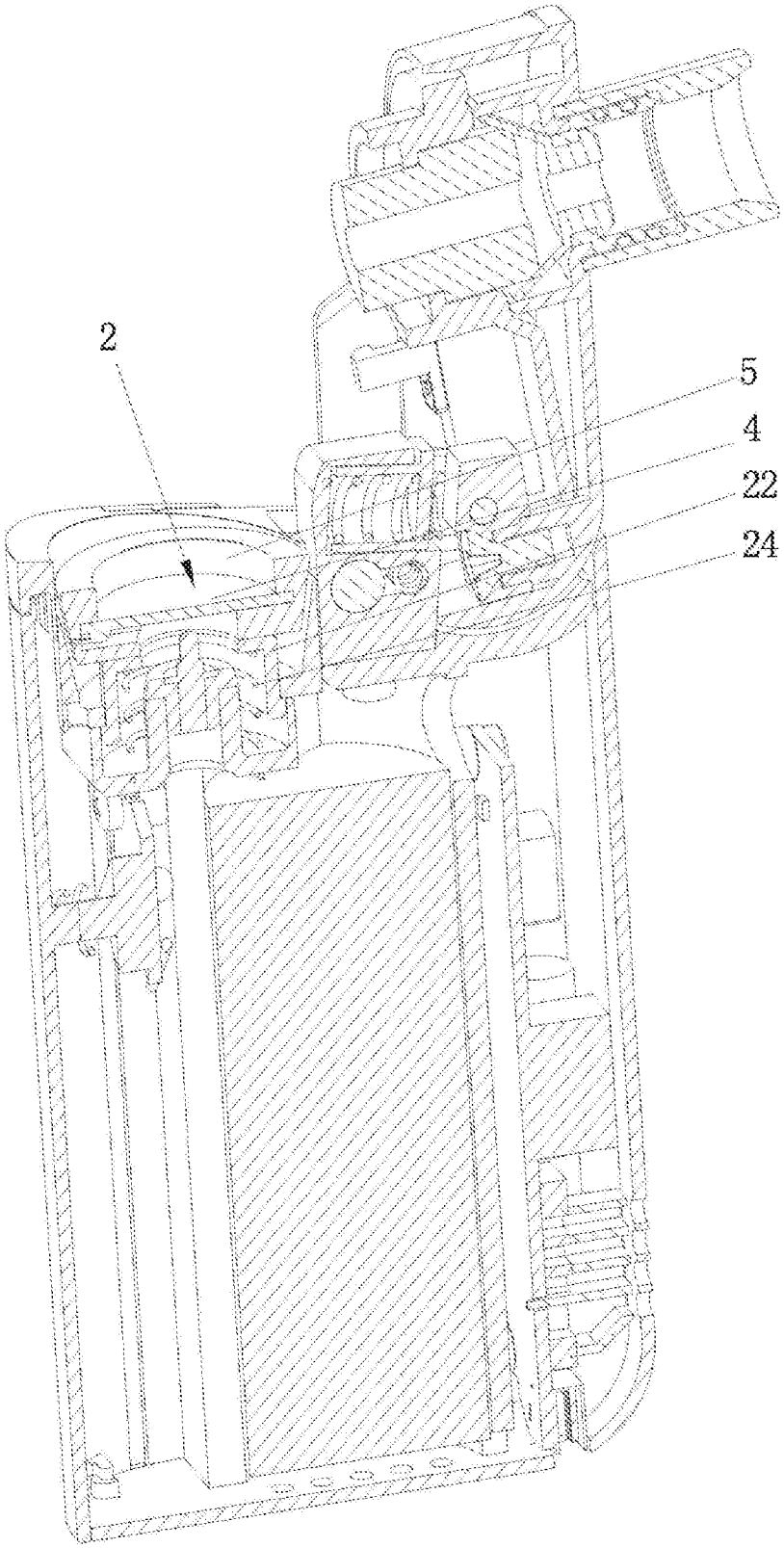
FIG. 7 is a schematic structural diagram of Embodiment 1 of the electronic cigarette when a press plate is unlocked and opened.
Figure 8:
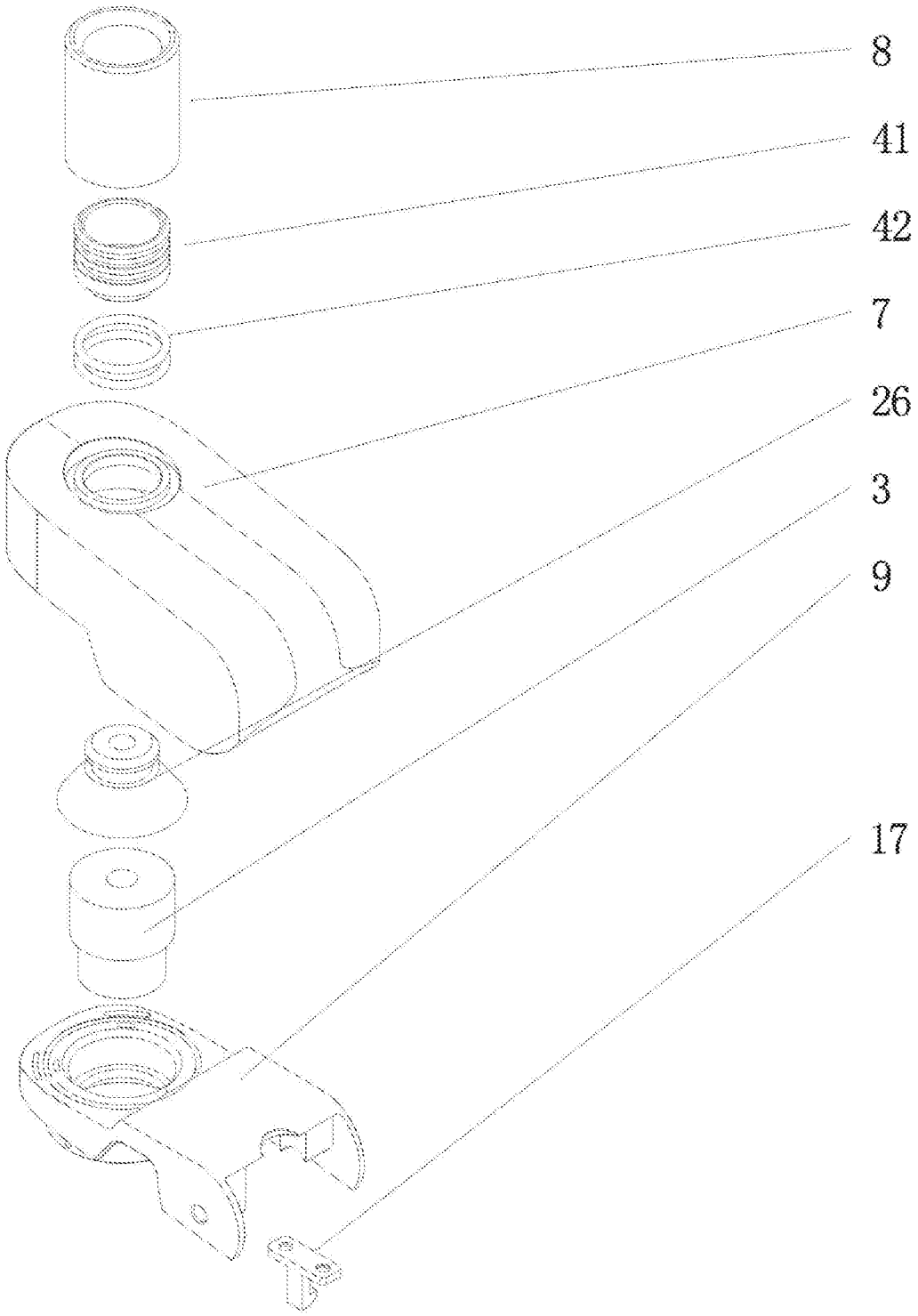
FIG. 8 is an exploded view of the upper part of Embodiment 1 of the electronic cigarette.
Figure 9:
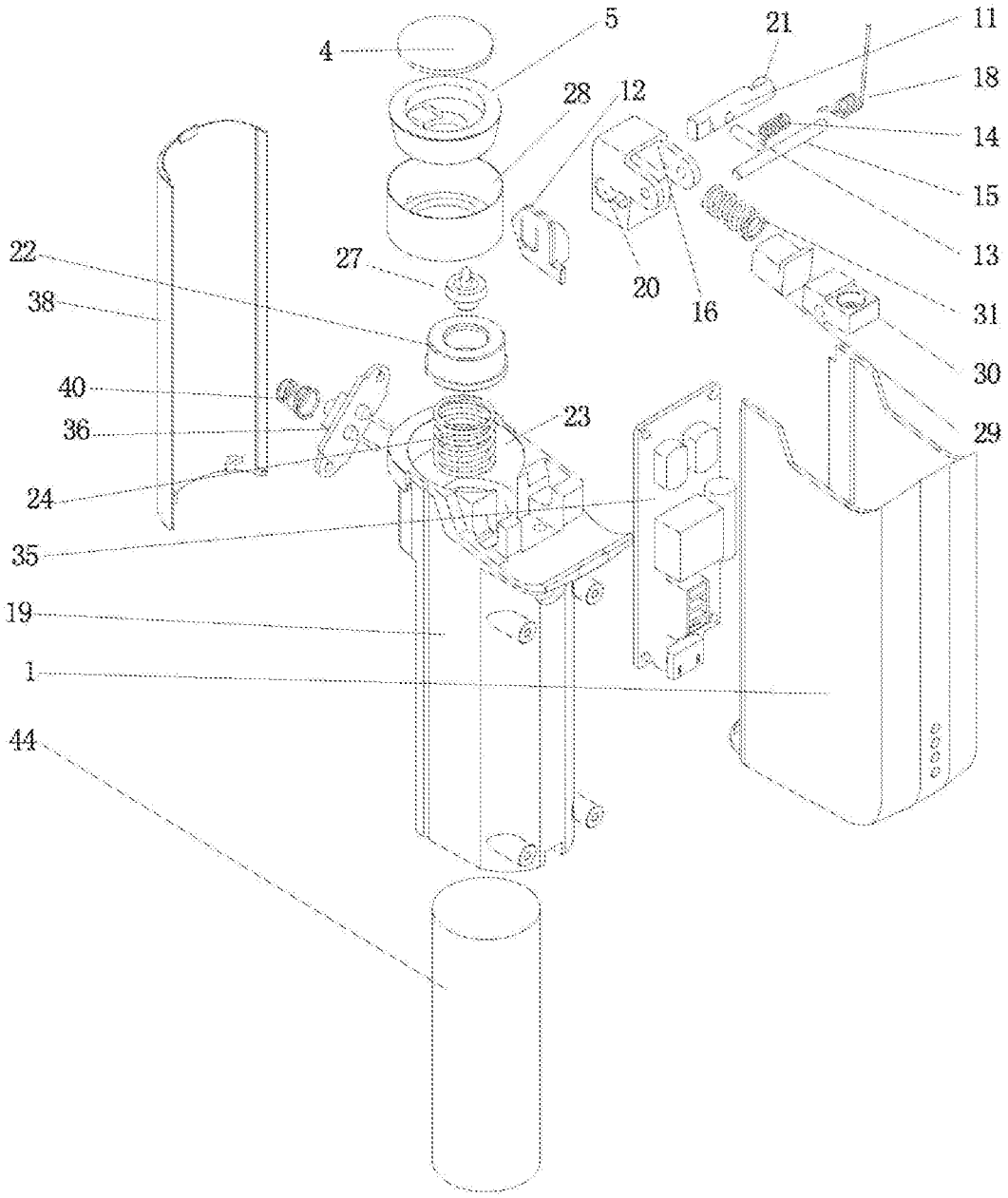
FIG. 9 is an exploded view of the lower part of Embodiment 1 of the electronic cigarette.

In which, 1 housing, 2 atomization sheet assembly, 3 cartridge, 4 ultrasonic atomization sheet, 5 atomization seat, 6 air inlet hole, 7 top cover, 8 suction nozzle, 9 press plate, 10 locking mechanism, 11 lock shaft, 12 key handle, 13 clamping shaft, 14 first spring, 15 rotating shaft, 16 rotating shaft seat, 17 lock, 18 elastic member, 19 support, 20 through slot, 21 lock hook, 22 ejection shaft, 23 groove, 24 second spring, 25 moving member, 26 first seal ring, 261 boss portion, 27 elastic electrode, 28 tapered seat, 29 slider, 30 rotating tongue, 31 third spring, 32 screw, 33 first lateral surface, 34 second lateral surface, 35 main board, 36 switch key, 37 limiting slot, 38 side panel, 39 raised portion, 40 fourth spring, 41 step shaft, 42 second seal ring, 43 top cover assembly, 44 battery, 46 first tobacco tar blocking cavity, 47 second tobacco tar blocking cavity.

DETAILED DESCRIPTION OF EMBODIMENTS

Embodiment 1

As shown in FIG. 1 to FIG. 9, an ultrasonic electronic cigarette in the first embodiment includes a housing 1 provided with an atomization sheet assembly 2 and a cartridge 3 therein, the atomization sheet assembly 2 includes an ultrasonic atomization sheet 4 and an atomization seat 5 for supporting and fixing the ultrasonic atomization sheet 4, a top cover 7 for sealing an opening of the housing 1 is connected to the top end of the housing 1, a suction nozzle 8 is connected to the top cover 7, a press plate 9 and a locking mechanism 10 for controlling the press plate 9 to be opened or closed are also disposed in the housing 1, and the cartridge 3 is fixed in the press plate 9; when the top cover 7 is closed and the locking mechanism 10 is locked, the press plate 9 and/or the cartridge 3 abut against the atomization sheet assembly 2, and the cartridge 3 is in contact with an atomization surface of the ultrasonic atomization sheet 4; and when the top cover 7 is opened and the locking mechanism 10 is unlocked, the press plate 9 drives the cartridge 3 to be separated from the ultrasonic atomization sheet 4, and the atomization sheet assembly 2 is exposed. The atomization seat 5 is a silica gel seat made of silica gel.

The locking mechanism 10 includes a lock shaft 11, a key handle 12, a clamping shaft 13, a first spring 14, a rotating shaft 15, a rotating shaft seat 16, a lock 17, and an elastic member 18 for springing off the press plate 9 when the locking mechanism 10 is unlocked; the lock 17 is fixedly connected to the press plate 9, the rotating shaft seat 16 is fixed on a support 19 in the housing 1, one end of the press plate 9 is rotatably connected to one end of the rotating shaft seat 16 through the rotating shaft 15, the lock shaft 11 is disposed in a through slot 20 of the rotating shaft seat 16, the key handle 12 is fixedly connected to one end of the lock shaft 11 and can drive the lock shaft 11 to move within the through slot 20, and the other end of the lock shaft 11 is provided with a lock hook 21 matching the lock 17; one end of the clamping shaft 13 is connected to the lock shaft 11, one end of the first spring 14 abuts against the rotating shaft seat 16, and the other end of the first spring 14 abuts against the other end of the clamping shaft 13.

The ultrasonic electronic cigarette is an ultrasonic electronic cigarette in liquid form in which the cartridge 3 is filled with tobacco tar and the ultrasonic atomization sheet is used to atomize the tobacco tar in the cartridge 3, the housing 1 is provided with an air inlet hole 6, and the air inlet hole 6, the atomization surface of the ultrasonic atomization sheet 4, and the suction nozzle 8 are communicated in sequence.

The elastic member 18 is a torsion spring, and the torsion spring is sleeved on the rotating shaft 15 and located between the press plate 9 and the support 19.

The ultrasonic electronic cigarette in the first embodiment further includes an ejection shaft 22, the ejection shaft 22 is arranged in a groove 23 at the top of the support 19 in the housing 1 and can move up and down within the groove 23, a second spring 24 is also disposed in the groove 23, the top end of the second spring 24 abuts against the inner top surface of the ejection shaft 22, and the bottom end of the second spring 24 abuts against the bottom surface of the groove 23; when the press plate 9 is locked, the bottom of the press plate 9 presses the ejection shaft 22 and compresses the second spring 24 through the atomization seat 5; and when the press plate 9 is unlocked, the second spring 24 is reset and the atomization sheet assembly 2 is ejected by the ejection shaft 22.

An elastic electrode 27 is also disposed on the support 19; when the atomization seat 5 presses the ejection shaft 22 and compresses the second spring 24, the elastic electrode 27 abuts against a first conductive layer on the inner bottom surface of the ultrasonic atomization sheet 4; and when the second spring 24 is reset, the atomization seat 5 drives the ultrasonic atomization sheet 4 to move up to be separated from the elastic electrode 27.

The atomization seat 5 is located in a tapered seat 28, and the inner lateral surface of the tapered seat 28 and the outer lateral surface of the atomization seat 5 are both tapered surfaces whose diameters are reduced from top to bottom.

The tapered seat 28 is made of a conductive material, and a pin on a second conductive layer of the ultrasonic atomization sheet 4 passes through the atomization seat 5 and is electrically connected to the tapered seat 28.

When the top cover 7 is closed, the key handle 12 is located inside the top cover 7; and when the top cover 7 is opened, the key handle 12 is exposed.

The bottom of the inner lateral surface of the first seal ring 26 is a tapered surface whose diameter is reduced from bottom to top; and when the top cover 7 is closed, the top of the cartridge 3 abuts against the bottom of the inner lateral surface of the first seal ring 26.

A slider 29, a rotating tongue 30 and a third spring 31 are also disposed in the housing 1, the rotating tongue 30 is sleeved on the rotating shaft 15 and can rotate around the rotating shaft 15, one end of the rotating tongue 30 is fixedly connected to one end of the top cover 7 by a screw 32, the other end of the rotating tongue 30 is provided with a first lateral surface 33 and a second lateral surface 34 that are adjacent, the slider 29 and the third spring 31 are both disposed in a lateral opening of the rotating shaft seat 16, one end of the third spring 31 abuts against the slider 29, and the other end of the third spring 31 abuts against the rotating shaft seat 16; when the top cover 7 is closed, the lateral surface of the slider 29 abuts against the first lateral surface 33 of the rotating tongue 30 and compresses the third spring 31; and when the top cover 7 is opened, the rotating tongue 30 rotates around the rotating shaft 15, so that the lateral surface of the slider 29 abuts against the second lateral surface 34 of the rotating tongue 30. At this time, the lateral surface of the slider 29 is attached to the second lateral surface 34 of the rotating tongue 30, and the top cover 7 is opened at 90° for replacement of the cartridge 3.

A main board 35 and a switch key 36 for controlling operation of the main board 35 are also fixed on the support 19 in the housing 1, the support 19 is provided with a limiting slot 37 with a downward opening, the top end of a side panel 38 of the housing 1 is disposed in the limiting slot 37 and can move within the limiting slot 37, and a raised portion 39 opposite to the switch key 36 is formed inside the side panel 38.

A fourth spring 40 is also disposed in the housing 1, one end of the fourth spring 40 is sleeved on the switch key 36, and the other end of the fourth spring 40 is sleeved on the raised portion 39.

The suction nozzle 8 is connected to the top cover 7 through a step shaft 41.

A second seal ring 42 is disposed between the suction nozzle 8 and the step shaft 41.

The suction nozzle 8, the second seal ring 42, the step shaft 41, the top cover 7, and the first seal ring 26 constitute a top cover assembly 43.

A battery 44 is also disposed in the housing 1.

Embodiment 2

Figure 10:
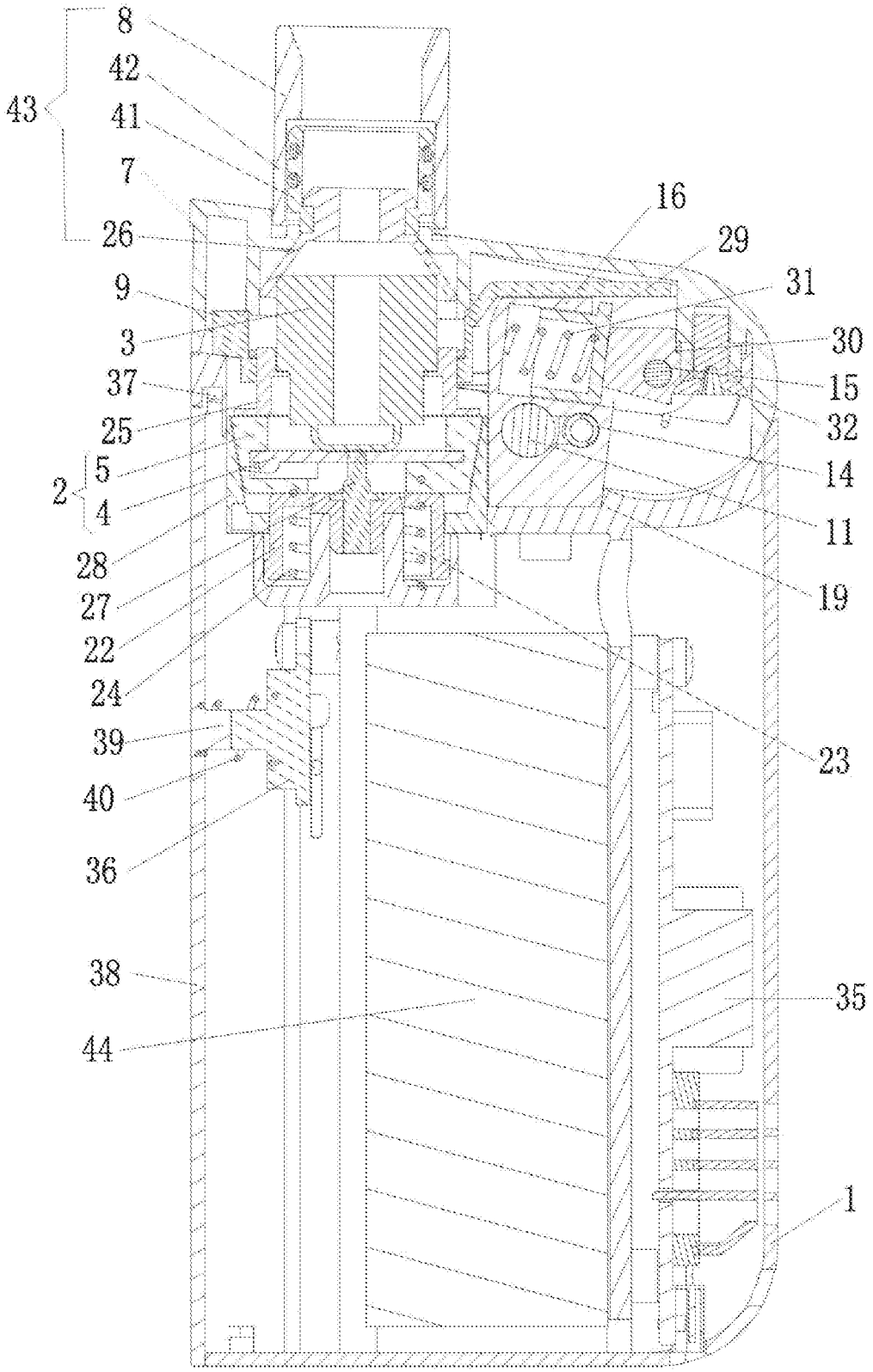
FIG. 10 is a schematic structural diagram of Embodiment 2 of an electronic cigarette in a use state.
Figure 11:
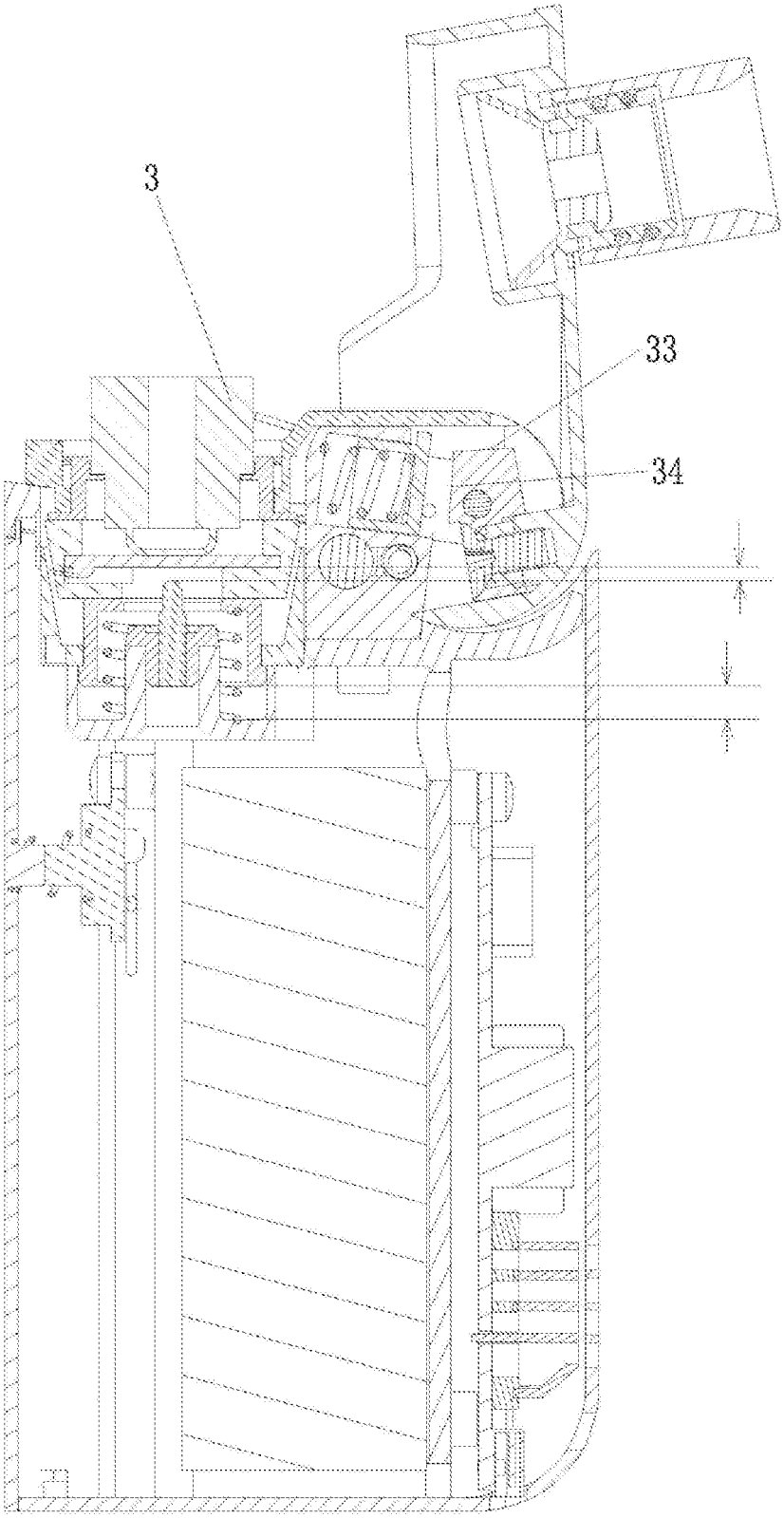
FIG. 11 is a schematic structural diagram of FIG. 10 after a top cover is opened.
Figure 12:
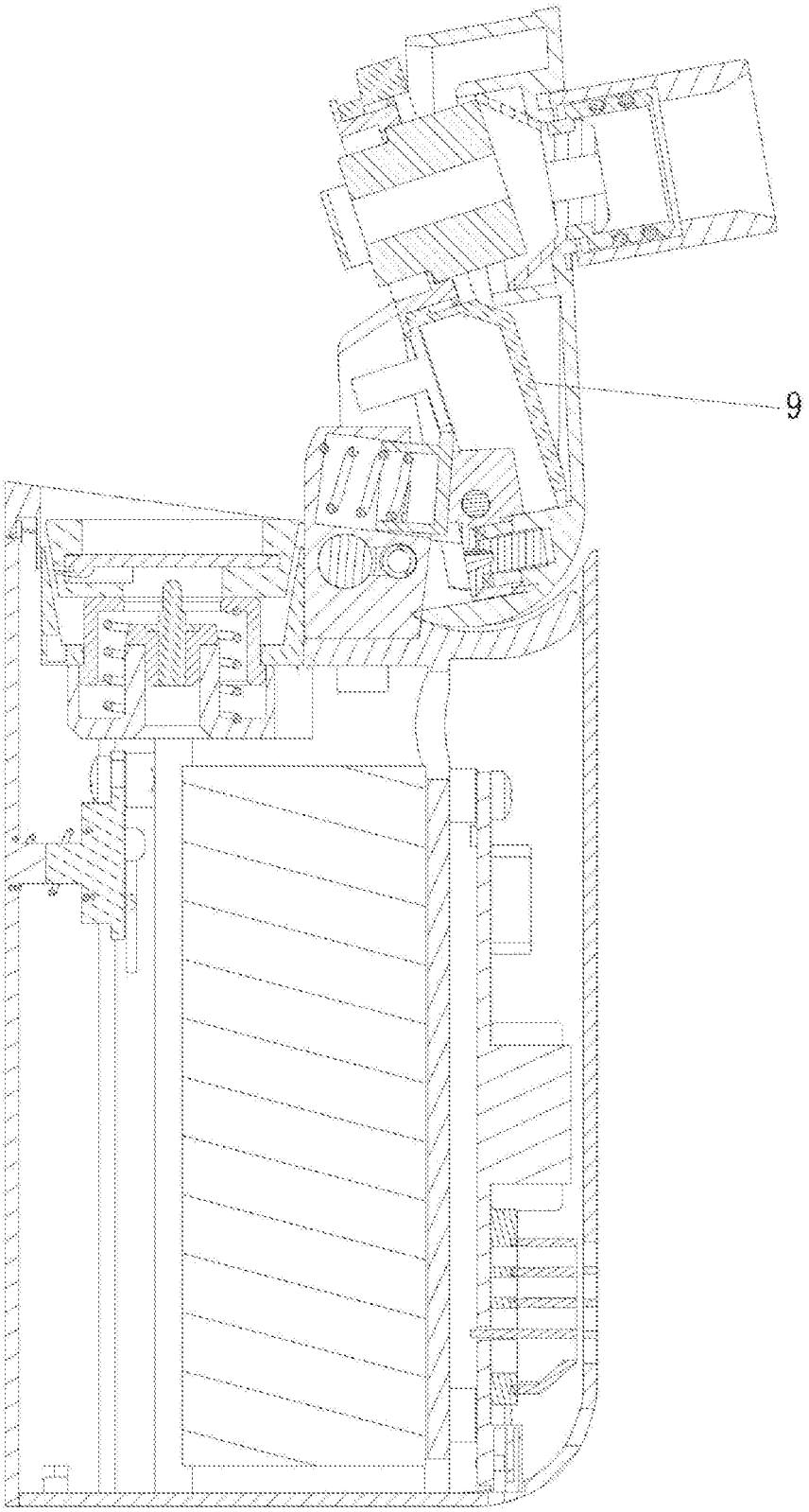
FIG. 12 is a schematic structural diagram of FIG. 10 when a press plate is unlocked and opened.

FIG. 10 to FIG. 12 show a structure of a second embodiment of an ultrasonic electronic cigarette. The structure of the second embodiment is similar to that of the first embodiment, except that a moving member 25 capable of moving up and down is also disposed in the housing 1, and a first seal ring 26 is also disposed in the top cover 7; when the top cover 7 is closed, the top cover 7 presses the ejection shaft 22 and compresses the second spring 24 through the first seal ring 26, the cartridge 3, the moving member 25, and the atomization seat 5 in sequence; and when the top cover 7 is opened, the second spring 24 is reset and ejects the cartridge 3 through the atomization seat 5 and the moving member 25 in sequence. When the second spring 24 jacks the ejection shaft 22, the ejection shaft 22 moves up a certain distance and then is stuck and limited by the tapered seat 28 to prevent the ejection shaft 22 from falling off. Therefore, based on the first embodiment, after the top cover 7 is opened, the cartridge 3 can be automatically ejected in the second embodiment. The same structure in the second embodiment as in the first embodiment is not described herein, which does not affect the understanding and implementation of the present invention by those skilled in the art.

Embodiment 3

Figure 13:
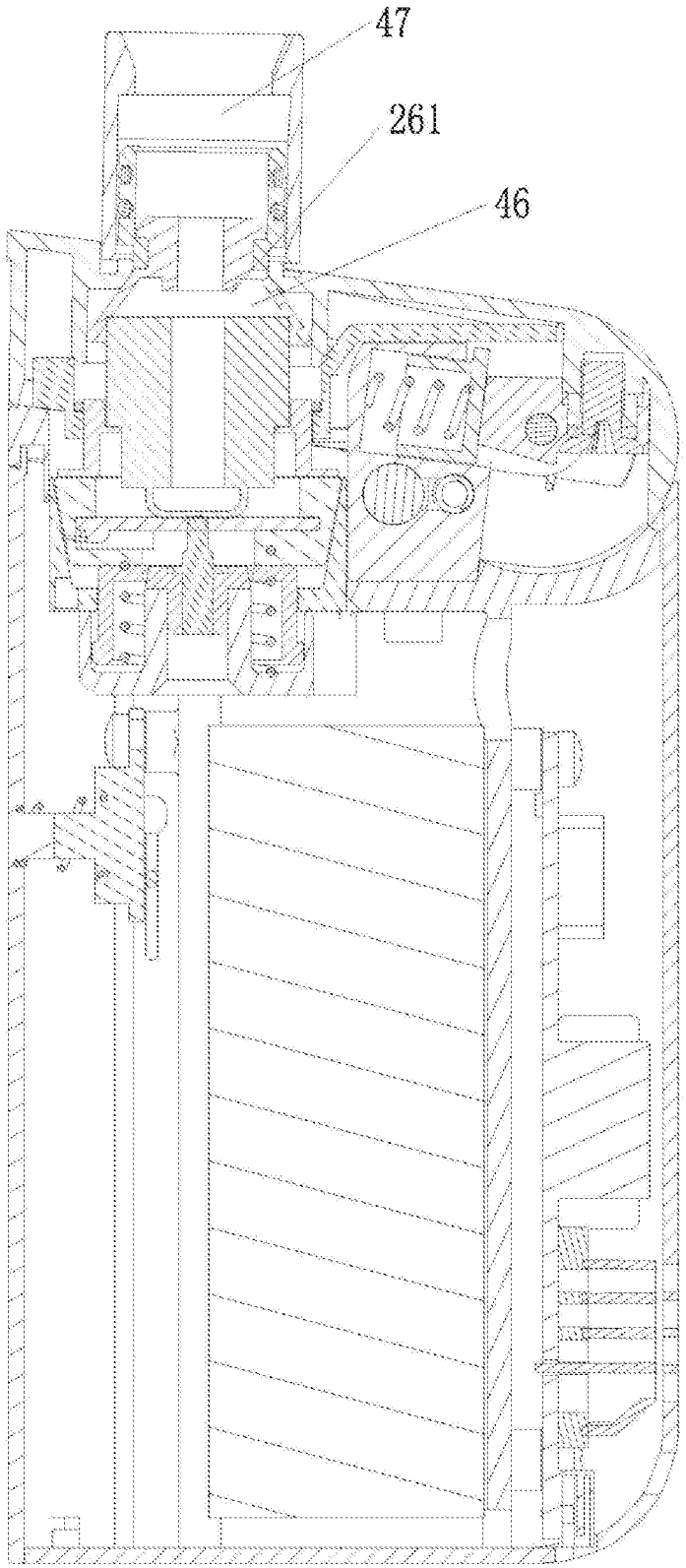
FIG. 13 is a schematic structural diagram of Embodiment 3 of an electronic cigarette in a use state.

FIG. 13 shows a structure of a third embodiment of an ultrasonic electronic cigarette. The structure of the third embodiment is similar to that of the second embodiment, except that the inner bottom surface of the first seal ring 26 has a downward boss portion 261, and the top end of the cartridge 3, the inner bottom of the first seal ring 26 and the boss portion 261 define a first tobacco tar blocking cavity 46. The inner diameter of the upper section of the suction nozzle 8 is smaller than the inner diameter of the lower section of the suction nozzle 8. The lower section of the suction nozzle 8 forms a second tobacco tar blocking cavity 47. When smoke passes, large granular tobacco tar beads are blocked within the first tobacco tar blocking cavity 46 and the second tobacco tar blocking cavity 47 to prevent from sucking the tobacco tar.

The same structure in the third embodiment as in the second embodiment is not described herein, which does not affect the understanding and implementation of the present invention by those skilled in the art.

The embodiments of the present invention are described above with reference to the drawings, but the present invention is not limited to the specific embodiments. The specific embodiments described above are merely illustrative but not restrictive. Many forms may also be made by those of ordinary skill in the art under the enlightenment of the present invention without departing from the purpose of the present invention and the scope of the claims, and these forms fall into the scope of the present invention.

The invention claimed is:

1. An ultrasonic electronic cigarette, comprising a housing (1), an atomization sheet assembly (2), and a cartridge (3) being disposed in the housing (1), wherein:

the atomization sheet assembly (2) comprises an ultrasonic atomization sheet (4) and an atomization seat (5) for supporting and fixing the ultrasonic atomization sheet (4);

a top cover (7) for sealing an opening of the housing (1) is connected to the top end of the housing (1), a suction nozzle (8) is connected to the top cover (7);

a press plate (9) and a locking mechanism (10) for controlling the press plate (9) to be opened or closed are also disposed in the housing (1), and the cartridge (3) is fixed in the press plate (9);

when the top cover (7) is closed and the locking mechanism (10) is locked, at least one of the press plate (9) or the cartridge (3) abut against the atomization sheet assembly (2), and the cartridge (3) is in contact with an atomization surface of the ultrasonic atomization sheet (4); and when the top cover (7) is opened and the locking mechanism (10) is unlocked, the press plate (9) drives the cartridge (3) to be separated from the ultrasonic atomization sheet (4), and the atomization sheet assembly (2) is exposed.

2. The ultrasonic electronic cigarette according to claim 1, wherein:

the locking mechanism (10) comprises a lock shaft (11), a key handle (12), a clamping shaft (13), a first spring (14), a rotating shaft (15), a rotating shaft seat (16), a lock (17), and an elastic member (18) for opening the press plate (9) when the locking mechanism (10) is unlocked;

the lock (17) is fixedly connected to the press plate (9);

the rotating shaft seat (16) is fixed on a support (19) in the housing (1);

one end of the press plate (9) is rotatably connected to one end of the rotating shaft seat (16) through the rotating shaft (15);

the lock shaft (11) is disposed in a through slot (20) of the rotating shaft seat (16);

the key handle (12) is fixedly connected to one end of the lock shaft (11) and can drive the lock shaft (11) to move within the through slot (20);

the other end of the lock shaft (11) is provided with a lock hook (21) matching the lock (17);

one end of the clamping shaft (13) is connected to the lock shaft (11);

one end of the first spring (14) abuts against the rotating shaft seat (16); and the other end of the first spring (14) abuts against the other end of the clamping shaft (13).

3. The ultrasonic electronic cigarette according to claim 2, further comprising an ejection shaft (22), wherein:

the ejection shaft (22) is arranged in a groove (23) at the top of the support (19) in the housing (1) and can move up and down within the groove (23);

a second spring (24) is also disposed in the groove (23);

a top end of the second spring (24) abuts against a inner top surface of the ejection shaft (22);

a bottom end of the second spring (24) abuts against a bottom surface of the groove (23);

when the press plate (9) is locked, the press plate (9) presses the ejection shaft (22) and compresses the second spring (24) through the atomization seat (5); and when the press plate (9) is unlocked, the second spring (24) is reset and the atomization sheet assembly (2) is ejected by the ejection shaft (22).

4. The ultrasonic electronic cigarette according to claim 3, wherein:

a moving member (25) capable of moving up and down is also disposed in the housing (1);

a first seal ring (26) is also disposed in the top cover (7);

when the top cover (7) is closed, the top cover (7) presses the ejection shaft (22) and compresses the second spring (24) through the first seal ring (26), the cartridge (3), the moving member (25), and the atomization seat (5) in sequence; and when the top cover (7) is opened, the second spring (24) is reset and ejects the cartridge (3) through the atomization seat (5) and the moving member (25) in sequence.

5. The ultrasonic electronic cigarette according to claim 3, wherein:

an elastic electrode (27) is also disposed on the support (19);

when the atomization seat (5) presses the ejection shaft (22) and compresses the second spring (24), the elastic electrode (27) abuts against a first conductive layer on an inner bottom surface of the ultrasonic atomization sheet (4); and when the second spring (24) is reset, the atomization seat (5) drives the ultrasonic atomization sheet (4) to move up to be separated from the elastic electrode (27).

6. The ultrasonic electronic cigarette according to claim 4, wherein:

an elastic electrode (27) is also disposed on the support (19);

when the atomization seat (5) presses the ejection shaft (22) and compresses the second spring (24), the elastic electrode (27) abuts against a first conductive layer on an inner bottom surface of the ultrasonic atomization sheet (4); and when the second spring (24) is reset, the atomization seat (5) drives the ultrasonic atomization sheet (4) to move up to be separated from the elastic electrode (27).

7. The ultrasonic electronic cigarette according to claim 3, wherein:

the atomization seat (5) is in a tapered seat (28); and an inner lateral surface of the tapered seat (28) and an outer lateral surface of the atomization seat (5) are both tapered surfaces whose diameters are reduced from top to bottom.

8. The ultrasonic electronic cigarette according to claim 4, wherein:

the atomization seat (5) is in a tapered seat (28); and an inner lateral surface of the tapered seat (28) and an outer lateral surface of the atomization seat (5) are both tapered surfaces whose diameters are reduced from top to bottom.

9. The ultrasonic electronic cigarette according to claim 7, wherein:

the tapered seat (28) is made of a conductive material; and a pin on a second conductive layer of the ultrasonic atomization sheet (4) passes through the atomization seat (5) and is electrically connected to the tapered seat (28).

10. The ultrasonic electronic cigarette according to claim 8, wherein:

the tapered seat (28) is made of a conductive material; and a pin on a second conductive layer of the ultrasonic atomization sheet (4) passes through the atomization seat (5) and is electrically connected to the tapered seat (28).

11. The ultrasonic electronic cigarette according to claim 2, wherein:

when the top cover (7) is closed, the key handle (12) is inside the top cover (7); and when the top cover (7) is opened, the key handle (12) is exposed.

12. The ultrasonic electronic cigarette according to claim 4, wherein:

a bottom of an inner lateral surface of the first seal ring (26) is a tapered surface whose diameter is reduced from bottom to top; and when the top cover (7) is closed, the top of the cartridge (3) abuts against the bottom of the inner lateral surface of the first seal ring (26).

13. The ultrasonic electronic cigarette according to claim 2, wherein:

a slider (29), a rotating tongue (30), and a third spring (31) are also disposed in the housing (1);

the rotating tongue (30) is sleeved on the rotating shaft (15) and can rotate around the rotating shaft (15);

one end of the rotating tongue (30) is fixedly connected to one end of the top cover (7);

the other end of the rotating tongue (30) is provided with a first lateral surface (33) and a second lateral surface (34) that are adjacent;

the slider (29) and the third spring (31) are both disposed in a lateral opening of the rotating shaft seat (16);

one end of the third spring (31) abuts against the slider (29);

the other end of the third spring (31) abuts against the rotating shaft seat (16);

when the top cover (7) is closed, the lateral surface of the slider (29) abuts against the first lateral surface (33) of the rotating tongue (30) and compresses the third spring (31); and when the top cover (7) is opened, the rotating tongue (30) rotates around the rotating shaft (15), so that the lateral surface of the slider (29) abuts against the second lateral surface (34) of the rotating tongue (30).

14. The ultrasonic electronic cigarette according to claim 1, wherein:

a main board (35) and a switch key (36) for controlling operation of the main board (35) are also fixed on the support (19) in the housing (1);

the support (19) is provided with a limiting slot (37) with a downward opening;

the top end of a side panel (38) of the housing (1) is disposed in the limiting slot (37) and can move within the limiting slot (37); and a raised portion (39) opposite to the switch key (36) is formed inside the side panel (38).

15. The ultrasonic electronic cigarette according to claim 14, wherein:

a fourth spring (40) is also disposed in the housing (1);

one end of the fourth spring (40) is sleeved on the switch key (36); and the other end of the fourth spring (40) is sleeved on the raised portion (39).

16. The ultrasonic electronic cigarette according to claim 12, wherein:

the inner bottom surface of the first seal ring (26) has a downward boss portion (261); and the top end of the cartridge (3), the inner bottom of the first seal ring (26), and the boss portion (261) define a first tobacco tar blocking cavity (46).

17. The ultrasonic electronic cigarette according to claim 1, wherein an inner diameter of an upper section of the suction nozzle (8) is smaller than an inner diameter of a lower section of the suction nozzle (8).

18. The ultrasonic electronic cigarette according to claim 1, wherein:

the ultrasonic electronic cigarette is an ultrasonic electronic cigarette in liquid form in which the cartridge (3)

is filled with tobacco tar and the ultrasonic atomization sheet is used to atomize the tobacco tar in the cartridge (3);

the housing (1) is provided with an air inlet hole (6); and the air inlet hole (6), the atomization surface of the ultrasonic atomization sheet (4), and the suction nozzle (8) are communicated in sequence.

19. The ultrasonic electronic cigarette according to claim 2, wherein the elastic member (18) is a torsion spring, and the torsion spring is sleeved on the rotating shaft (15) and located between the press plate (9) and the support (19).

* * * * *